US010170252B2

(12) United States Patent
Koepsell

(10) Patent No.: US 10,170,252 B2
(45) Date of Patent: Jan. 1, 2019

(54) MICRO-SWITCH AND METHOD OF MANUFACTURE

(71) Applicant: Johnson Electric S.A., Murten (CH)

(72) Inventor: Martin Koepsell, Ennepetal (DE)

(73) Assignee: JOHNSON ELECTRIC S.A., Murten (CH)

( * ) Notice: Subject to any disclaimer, the term of this patent is extended or adjusted under 35 U.S.C. 154(b) by 251 days.

(21) Appl. No.: 14/622,331

(22) Filed: Feb. 13, 2015

(65) Prior Publication Data

US 2015/0235780 A1 Aug. 20, 2015

(30) Foreign Application Priority Data

Feb. 15, 2014 (DE) ..... 10 2014 002 104
Apr. 24, 2014 (DE) ..... 10 2014 006 033

(51) Int. Cl.
*H01H 1/02* (2006.01)
*H01H 13/02* (2006.01)
*H01H 11/06* (2006.01)

(52) U.S. Cl.
CPC ..... *H01H 1/02* (2013.01); *H01H 11/06* (2013.01); *H01H 13/02* (2013.01); *H01H 2011/067* (2013.01); *H01H 2201/024* (2013.01); *Y10T 29/49105* (2015.01)

(58) Field of Classification Search
CPC ..... H01H 1/02; H01H 11/06; H01H 71/08; B29C 65/64
USPC ..... 200/402, 408, 409, 456, 502, 268
See application file for complete search history.

(56) References Cited

U.S. PATENT DOCUMENTS

| | | | | |
|---|---|---|---|---|
| 6,274,834 | B1 | 8/2001 | Okada et al. | |
| 2005/0109601 | A1 | 5/2005 | Collot et al. | |
| 2005/0151170 | A1* | 7/2005 | Zhang | H01H 1/0094 257/222 |
| 2013/0213779 | A1* | 8/2013 | Borgwardt | H01H 71/08 200/275 |

FOREIGN PATENT DOCUMENTS

| | | | | |
|---|---|---|---|---|
| DE | 202006018987 | | 4/2007 | |
| EP | 0 170 589 | A1 | 2/1986 | |
| EP | 0170589 | * | 5/1986 | H01H 11/00 |
| EP | 0600634 | | 6/1994 | |
| EP | 1585155 | | 10/2005 | |

* cited by examiner

*Primary Examiner* — Renee Luebke
*Assistant Examiner* — Iman Malakooti
(74) *Attorney, Agent, or Firm* — Muncy, Geissler, Olds & Lowe, P.C.

(57) ABSTRACT

An electric micro-switch has at least one electric contact. The contact has a profiled section. The profiled section has a longitudinal extension, a bent portion formed in the longitudinal extension and having an outer surface that is, at least in section, formed in a rounded manner. A contact region is defined on the outer surface of the bent portion. A method for manufacturing the micro-switch is also disclosed.

12 Claims, 3 Drawing Sheets

MICRO-SWITCH AND METHOD OF MANUFACTURE

CROSS REFERENCE TO RELATED APPLICATIONS

This non-provisional patent application claims priority under 35 U.S.C. § 119(a) from Patent Application No. DE102014002104.1 filed in Germany on Feb. 15, 2014, and from Patent Application No. DE102014006033.0 filed in Germany on Apr. 24, 2014, the entire contents of which are hereby incorporated by reference.

FIELD OF THE INVENTION

This invention relates to an electric micro-switch and in particular, to a contact for a micro switch and its method of manufacture.

BACKGROUND OF THE INVENTION

Electric micro-switches are the part of electric circuits which switch them on and off. The contacts and the connections are therefore made of good electrically conductive materials. Micro-switches form a part of complex assemblies. In vehicles they are typically used in closing systems for doors, front hoods, tailgates, sliding roofs etc. They typically switch small control currents which are evaluated by microprocessors. The essential performance feature of a micro-switch is the time within which the switching operation is completed. This time is called bounce time. To ensure reliable evaluation in the control unit this bounce time must be very short and constant across the different operating states and environmental influences (e.g. temperature fluctuations).

The bounce time is influenced by the masses moved, the speed of the jump operation, the geometry of the involved contact surfaces and the electrical surface properties of the contact surfaces. In order to ensure a bounce time which is constant and low across time and environmental influences the following known values are to be aimed for:

- Small moved mass. The mechanical pulse triggering the mechanical vibration increases with an increase in mass.
- High jump speed (actuating speed for sliding contacts). The jump speed (for a flight of the movable contact) is constructionally given by the jump mechanism. A hard spring produces a quick jump. For sliding contacts the jump speed depends on the speed of actuation.
- Constant contact geometry across all operating states and time. Deformations due to switching surges and abrasion shall not change the geometry over its lifetime. Ideally the contact surfaces touch each other in a theoretically point-like manner. In reality the contact load results in an elliptically flattened contact region, via which the current flows. This ideal contact region is to be maintained over a maximum area, even if angular deviations of the contact surfaces relative to each other occur. It is ideal if the contacts involved comprise a hardness which is high but differs between individual contacts. As a result geometry deviations and abrasions during unavoidably occurring relative movements are avoided.
- Low electrical resistance in the contacting area between the contacts. The aimed for low resistance is the reason for applying precious metal layers or other contact layers in the area where the contacts touch.

- Low electrical resistance is also encouraged by small point-like contact surfaces.

All metal surfaces are coated with a continuous layer of foreign atoms. Ideally this layer of (non-conducting) foreign atoms is so thin that a tunnel current can flow through these layers (foreign platings) without resistance. This property is found in layers manufactured from hard gold. Thicker foreign coating layers may be penetrated in the contacting surfaces by strong pressing. Point-like contacting surfaces produce maximum pressing and tolerate large angular deviations without losing the point-like contact.

According to DE 10 2006 043 795 B3 contacts are formed as cylindrical hollow-form sections. With the micro-switch described here the possibility of vibrations (bouncing) occurring during the approach to a counter contact is very small (<1 ms). The mass is reduced compared to normal contacts made of solid material, so that the pulse for vibrations is reduced. The point-like contact (elliptical flattening being achieved during touching) is achieved due to the cylindrical contact surfaces arranged roughly at right angles to each other. This optimal contacting is maintained even for angle errors. Here high material hardness of the contacts involved was aimed for, the re-shaping process to obtain a cylinder supported the increase in hardness. The contact described here comprises a precious metal layer selectively applied to areas of the hollow-form section. This already led to a saving in precious metal. A selective galvanic process was used, preferably a brushing process. To reduce the precious metal to an extreme extent, application on one side only was proposed, wherein in operation the precious metal layer is achieved through material transfer from the counter contact.

SUMMARY OF THE INVENTION

Hence there is a desire for an electric micro-switch where the occurrence of vibrations during the switching jump is reduced as in the state of the art, but where compared to the state of the art, has a simple constructional shape with little use of precious metal and low manufacturing cost. In addition a method is provided with which the above-mentioned micro-switch can be can be manufactured in an efficient manner.

This is achieved in the present invention by using at least one contact having a profile section with a contact region, into the longitudinal extension of which a bent portion is introduced and the outer surface of which in this bent portion is formed rounded, at least in section.

Based on this bent section introduced in the longitudinal extension of the contact region a first arching of the contact region is created. A second arching is formed due to the outer surface of the contact region being rounded in the bent portion. In this way the contact region is arched in two planes, bending and rounding for these archings may be effected by embossing processes. The planes of the two archings are roughly perpendicular to each other.

This special shaping of the contact permits a point-like contact with a counter contact. Due to the point-like contact a high pressing force is applied to the counter contact in order to penetrate the layer of foreign atoms.

The contact is preferably manufactured from a solid material, further preferably it is formed as a stamped component. The stamped component may be of a narrow shape, prior to stamping it was hardened by rolling the corresponding "hard shoulder". Hardening in the contact region is further increased by the subsequent embossing process for realizing the archings in two planes.

A counter contact may, according to a further development of the invention, be formed with a planar contact region. This planar contact region can be made to contact the bent portion of the contact, wherein contacting is effected point-like, including, for example, for angular deviations created by tolerances.

A layer of an electrically conductive material may be applied to the contact region, wherein this electrically conductive material may be a precious metal or a carbon structure. The counter contact may be part of a leaf spring, which is clamped between contacts.

The counter contact belongs to the moving part of the micro-switch, whilst the contacts with the bent portion are stationary. For this reason the micro-switch according to the invention has contacts with minimized moving masses. The planar construction of the contact region of the counter contact is a low-mass form. This minimizes mechanical pulses which trigger mechanical vibrations.

The counter contact with planer contact region may be formed in a planar manner. This form is stiffer compared to arched or other complicated shapes. As a result a high jump speed is achieved, which reduces switching time. In conjunction with the minimized movable mass the bounce time is shortened compared to known constructions. Due to this construction of contact and counter contact small point-like contact surfaces are produced. The ideal point-like contact is realized and is maintained for angular deviations.

As regards the method, the requirement is met according to the invention in that at least one contact is stamped from an electrically conductive material and its contact region is embossed, in that the contact region of each contact is plated with an electrically conductive material in liquid phase and in that the contact plated with a hard layer of this electrically conductive material is inserted into a switch housing.

In the manufacturing process the first thing to be produced is the contacts. The contact with the bent portion is stamped from an electrically conductive material and subsequently its contact region is embossed. During embossing the bent portion is formed and the outer surface of the contact region is rounded.

Thereafter the contact region is coated with an electrically conductive material in liquid phase. This electrically conductive material forms a hard layer. Finally the contacts are inserted into a switch housing. Contacts and counter contact are arranged in the switch housing, the counter contact is acted upon by a plunger to change switching states.

Coating/plating of the contact region of each contact is preferably carried out in an immersion process. The immersion process may for example comprise a galvanic bath, in which contact regions are plated with precious metal ions. However, non-galvanic baths may also be used, for example when the electrically conductive material is based on carbon. Application of the electrically conductive material in the contact region reduces the electric resistance in the area where the contacts touch each other.

If precious metal is to be avoided, carbon surfaces may alternatively be used. Here hard modifications of carbon such as graphene or fullerene are preferred. Graphene is the name for a modification of the carbon with a two-dimensional structure. Fullerene is the name for a modification of carbon with a high three-dimensional structure and symmetry.

Application of the carbon material is carried out according to the invention from the liquid phase with carbon dissolved therein. Application may be effected in a bath, or alternatively by means of spraying or printing. The layers of carbon are created after application in the liquid phase, following vaporization of the solvent.

Application of e.g. graphene may also be effected by means of an inkjet printer, this leads to hard electrically conducting layers. As a solvent for graphene liquid transition metals may be used, during cooling graphene arranges itself in a self-organizing manner on the surface.

As a result of the manufacturing process the contacts involved, i.e. both the contact with bent portion and the planar counter contact, comprise a great hardness, but a hardness which varies between the contacts. This prevents geometry changes through mechanical pulses, such as through reshaping or compressing, also abrasion for unavoidably occurring relative movements. A constant contact geometry across all operating states and time is ensured.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
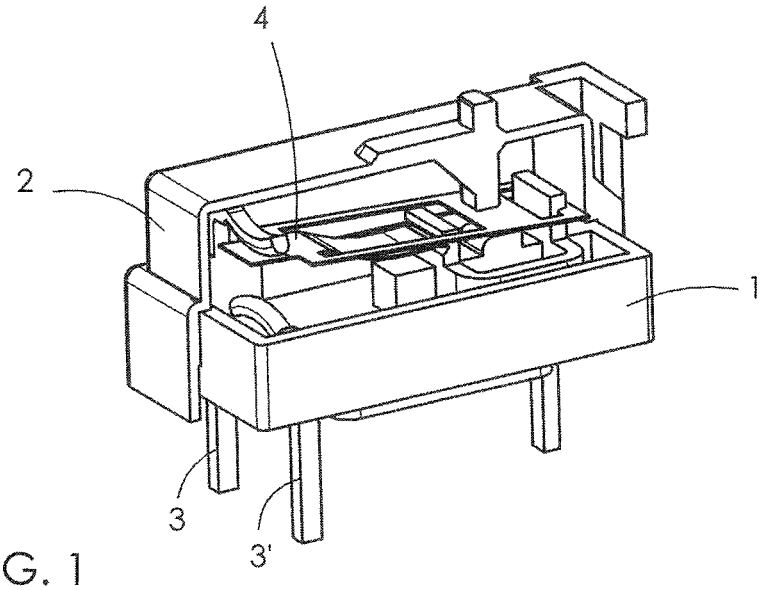
FIG. 1 is a perspective, partially sectioned view of a micro-switch according to the invention.

The micro-switch of FIG. 1 comprises an approximately rectangular-shaped construction, it has a trough-like lower part or base 1 and a lid part or housing 2 which is fixed to the base 1. Inside the micro-switch 1 are arranged contacts, i.e. contacts 3, 3' and a counter-contact 4.

Figure 2:
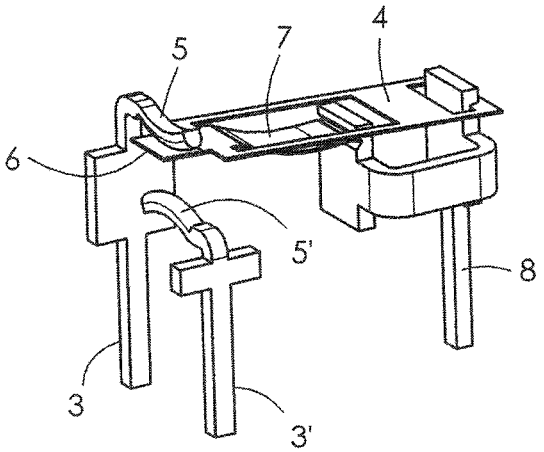
FIG. 2 and FIG. 3 are perspective views of the electrically conductive components of the micro-switch of FIG. 1, in different switching states.
Figure 3:
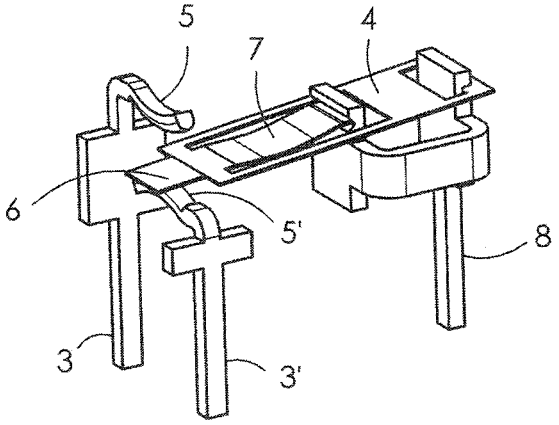

FIGS. 2 and 3 show that the contacts 3, 3' comprise contact regions 5, 5', which have a bent portion in their longitudinal extensions. In addition the outer surfaces of the bent contact regions 5, 5' are formed rounded on facing sides.

The counter contact 4 has a planar contact region 6, this is in electrically conducting contact with the upper contact 5 in FIG. 2 and is in electrically conducting contact with the lower contact 5' in FIG. 3. The counter contact 4 is equipped with a snap-action spring 7 and is engaged in a corresponding spring holder 8.

Figure 4:
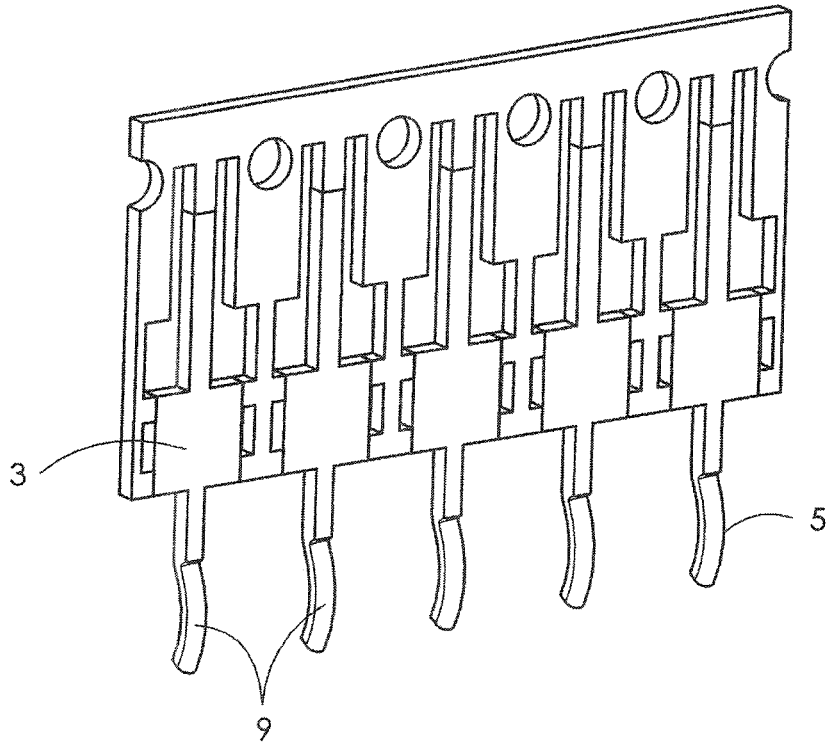
FIG. 4 and FIG. 5 are perspective views of stamped original components for a contact of the micro-switch of FIG. 1, at different stages of manufacture.
Figure 5:
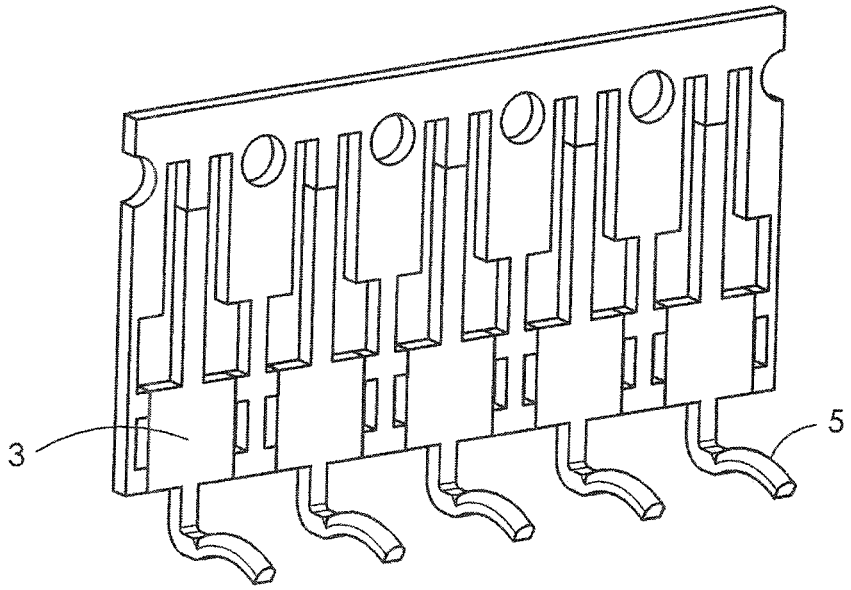

FIGS. 4 and 5 show that contact 3 is formed as a stamped component. The contact 3 is produced by stamping a sheet of conductive material, such as brass, the contact region 5 is formed by an embossing process. The embossing process leads to the dual arching in the contact region 5.

The contact region 5 is plated with an electrically conductive material 9. This material 9 may be a precious metal or may have a carbon basis. This material 9 may be applied by immersing, spraying, printing or the like. Preferably it is applied using an ink jet printer.

Contact 5' is made in a similar manner.

Figure 6:
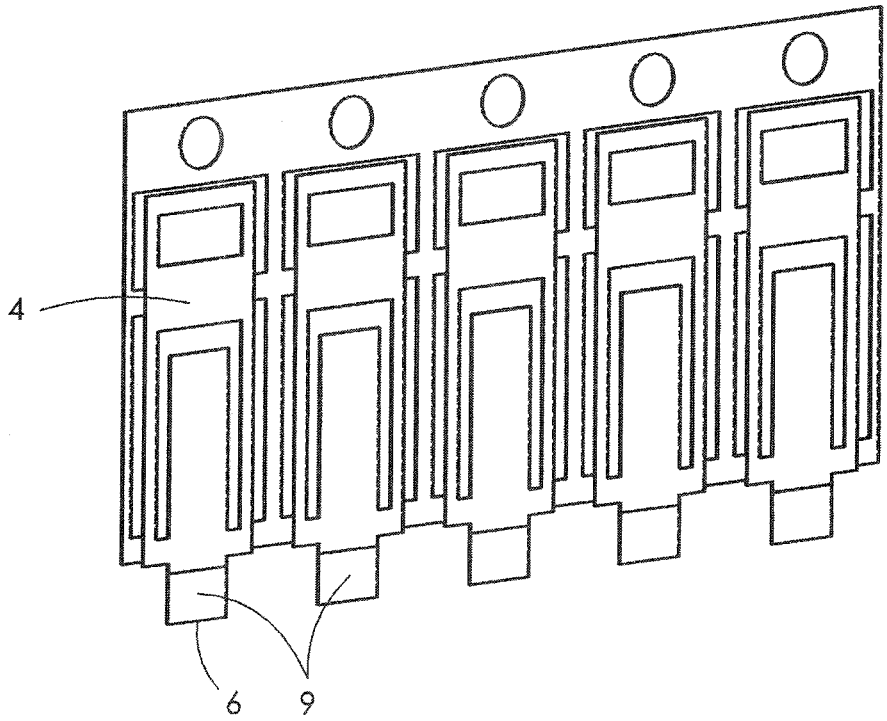
FIG. 6 and FIG. 7 are perspective views of stamped original components for a counter contact of the micro-switch of FIG. 1 at different stages of manufacture.
Figure 7:
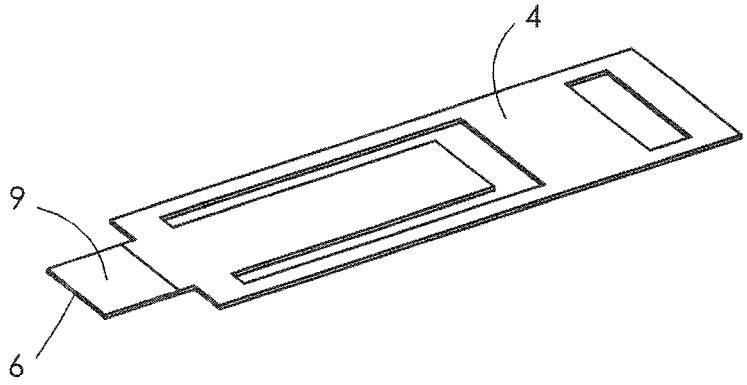

FIG. 6 and FIG. 7 show that the counter contact 4 is also a stamped component, the contact region 6 of which is plated with the electrically conductive material 9. Preferably, the material of the counter contact 4 is a sheet spring conductive material such as beryllium copper.

As described above and shown in the Figures, the stationary contact(s) and the moving contact achieve a point contact by design, in a simple cost effective manner.

The moving contact is formed of a leaf-spring which following manufacture is essentially flat. Its functional partially bent shape is created during assembly.

The stationary contact is formed by a narrow stamped section, which is arched in two planes. This form is preferably produced in the stamping tool by bending and embossing. Due to these simple forms the contacts are able to touch in an optimal point-like fashion (an elliptical flattening is created during touching), wherein the point-like touching is maintained even for large angular deviations.

The aim is to achieve a high degree of material hardness of the basic contact bodies involved and the contact layers applied. The rolling process for manufacturing the punched strips allows the material hardness of the basic body to be set to almost any desired (high) level. The bending and embossing process carried out on the stationary contact supports the increase in hardness precisely in the contact area.

Vibrations (bouncing) are prevented by a further reduction in the mass moved during the switching jump. In addition the pressure of the actuator acts upon the leaf spring in a vibration-dampening manner.

For large series production the most economic process is that of electroplating using belts which carry the components to be plated. The simplest method of selectively plating belts comprises partially immersing the moving belt in a galvanic bath, with a current between the belt and the bath. The design of the contacts permits them being embedded in stamping belts, where, save for the parts required for the function, no further parts are wetted in the bath and where thus no unnecessary areas are coated. Compared to complete dipping the amount of precious metal required is less.

This design of the contacts and the belt also permits coating by immersing the moving belt in non-galvanic baths.

If a further reduction in precious metal is desired, one-sided coating is possible.

To further reduce the precious metal content, a solid layer of carbon may be applied with only the opposite contact being coated with precious metal.

Optionally, the contact surfaces may be formed solely of carbon while completely omitting the precious metal.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. An electric micro-switch comprising a switching mechanism having two stationary electric contacts and at least one counter contact engaged in a spring holder, wherein each stationary contact has a profiled section, and the profiled section has a longitudinal arched extension, a bent portion formed in the longitudinal arched extension and having an outer surface that is, at least in section, formed in a rounded manner, and a contact region defined on the outer surface of the bent portion, a longitudinal direction of the two stationary electric contacts is transverse to a longitudinal direction of the counter contact, the two stationary electric contacts and the spring holder are not coplanar, and a longitudinal extension of the counter contact is perpendicular to the longitudinal extension of the stationary electric contact.

2. The micro-switch of claim 1, wherein each contact is manufactured from a solid material.

3. The micro-switch of claim 2, wherein each contact is a stamped component.

4. The micro-switch of claim 1, wherein the counter contact has planar contact region.

5. The micro-switch of claim 1, wherein a layer of an electrically conductive material is applied to each contact region.

6. The micro-switch of claim 5, wherein the electrically conductive material is a precious metal.

7. The micro-switch of claim 5, wherein the electrically conductive material is carbon.

8. A method for manufacturing the micro-switch of claim 1, comprising the steps of:

stamping the at least one contact out of an electrically conductive material and embossing its contact region;

coating the contact region of the or each contact with an electrically conductive material in liquid phase; and inserting the contact into a switch housing, after the electrically conductive material has hardened.

9. The method of claim 8, further providing at least one counter contact having a planar contact region and coating the planar contact region with an electrically conductive material in liquid phase.

10. The method of claim 8, wherein coating the contact region of the or each contact with the electrically conducting material is carried out in an immersion process.

11. The method of claim 8, wherein plating the contact region of the or each contact with the electrically conducting material is carried out in an spraying process.

12. The method of claim 11, including by using at least one inkjet printer for the spraying process.

* * * * *